US006770185B2

(12) United States Patent
Jordan et al.

(10) Patent No.: US 6,770,185 B2
(45) Date of Patent: Aug. 3, 2004

(54) AQUEOUS SOLUTION FOR ELECTRODEPOSITING TIN-ZINC ALLOYS

(75) Inventors: Manfred Jordan, Salach (DE); Gernot Strube, Geislingen (DE)

(73) Assignee: Dr.-Ing. Max Schlotter GmbH & Co. KG, Geislingen/Steige (DE)

( * ) Notice: Subject to any disclaimer, the term of this patent is extended or adjusted under 35 U.S.C. 154(b) by 422 days.

(21) Appl. No.: 09/854,131

(22) Filed: May 11, 2001

(65) Prior Publication Data

US 2002/0046954 A1 Apr. 25, 2002

Related U.S. Application Data

(63) Continuation of application No. PCT/EP99/08724, filed on Nov. 12, 1999.

(30) Foreign Application Priority Data

Nov. 12, 1998 (DE) ..... 198 52 219

(51) Int. Cl.[7] ..... C25D 3/56; C25D 3/60
(52) U.S. Cl. ..... 205/244; 205/253
(58) Field of Search ..... 205/244, 245, 205/246, 252, 253, 254; 106/1.22, 1.29

(56) References Cited

U.S. PATENT DOCUMENTS 4,168,223 A 9/1979 Igarashi et al.
4,184,928 A 1/1980 Hoije
5,378,346 A 1/1995 Ashiru et al.
5,409,592 A * 4/1995 Meyer et al. ..... 205/105
5,951,841 A * 9/1999 Wehlage et al. ..... 205/261
6,183,545 B1 * 2/2001 Okuhama et al. ..... 106/1.18

FOREIGN PATENT DOCUMENTS

| | | |
|---|---|---|
| EP | 0 663 460 A1 | 7/1995 |
| GB | 2 266 894 A | 11/1993 |
| JP | 10168592 | 6/1998 |

* cited by examiner

*Primary Examiner*—Roy King
*Assistant Examiner*—W. T. Leader
(74) *Attorney, Agent, or Firm*—Scully, Scott, Murphy & Presser

(57) ABSTRACT

The invention relates to an aqueous solution comprising the following components: Zn(II) ions, Sn(II) ions, aliphatic carboxylic acids and/or their alkaline salts, anionic surfactants, non-ionogenic surfactants and optionally aromatic aldehydes, aromatic ketones, aromatic carboxylic acids and heterocyclic carboxylic acids or their alkaline salts or conducting salts. The inventive solution provides a means for electrodepositing uniform light-colored tin-zinc alloys without having to use cyanide ions, allowing low energy consumption and few requirements in terms of the control of the bath.

14 Claims, No Drawings

AQUEOUS SOLUTION FOR ELECTRODEPOSITING TIN-ZINC ALLOYS

CROSS-REFERENCE TO RELATED APPLICATION

The present application is a continuation of Ser. No. PCT/EP99/08724 filed Nov. 12, 1999.

The present invention relates to an aqueous solution for the deposition of tin-zinc alloys, especially an electroplating bath permitting the deposition of tin-zinc alloys from a cyanide-free tin(II)-zinc(II) solution with simple bath management.

Products coated with a tin-zinc alloy by electroplating are characterised by excellent corrosion resistance. Especially the resistance against hydraulic fluid and aqueous salt solutions make products coated in this manner interesting for the automobile industry. Owing to their corrosion resistance and the excellent solderability, products coated with a tin-zinc alloy are also used in the wireless, electro and construction industry.

Electroplating baths common in the past contained tin in the oxidation stage +IV and cyanide ions. However, such electroplating baths have the disadvantage that a higher energy input than for tin(II) ions is necessary for depositing tin(IV) ions. In addition, bath management is faced with the complication that, upon dissolution of the anode, which advantageously also consists of a tin-zinc alloy, the formation of tin(IV) ions must be assisted by formation of a film by means of polarisation. In addition, the thickness and composition of the deposited tin-zinc alloy depends on the current density and thus the geometry of the substrate. In addition, the toxicity of the cyanide ions makes industrial utilisation more difficult.

The latter problem was solved in U.S. Pat. No. 5,378,346 by replacing the cyanide ions with alkali tartrates as complexing agents. However, the problems caused by the use of tin(IV) ions are not solved.

According to EP 0 663 460, an electroplating bath is known which permits the deposition of tin from the stage of the divalent tin so that the necessary energy input may be reduced. The dependence of the rate and composition of the tin-zinc deposition on the current density was also decreased. However, the amphoteric surfactants proposed in this reference lead to a situation where bath management remains critical and must be adjusted and supervised with great accuracy in order to prevent dark and faulty depositions.

It was therefore the object of the present invention to provide an electroplating bath solution for depositing tin-zinc alloys which does not contain cyanide, permits reduced energy consumption during deposition because tin is deposited from a solution containing tin(II) ions, and the bath management of which is not critical over a wide range of freely selectable parameters and permits depositions free of faults and discolouration.

The above object is achieved by an aqueous solution which, in addition to tin(II) and zinc(II) ions, contains aliphatic carboxylic acids and/or alkali salts thereof as complexing agents as well as a mixture of anionic and non-ionic surfactants as grain refining agents.

In an advantageous embodiment, the aqueous solution of the invention also contains aromatic aldehydes and/or aromatic ketones as brighteners. Preferably, aldehydes or ketones, respectively, of the following formulae (I) and (II), respectively are used:

$$AR—R—CO—R' \quad (I)$$

wherein AR=phenyl, naphthyl; R=$CH_2$, CH=CH and R'=H, $C_{1-3}$ alkyl.

(II)

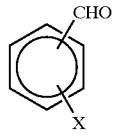

wherein X=H, $CH_3$, $OCH_3$, Cl, Br.

A special advantageous compound of the formula (II) is o-Cl-benzaldehyde.

The pH value of the solution is preferably 2–8, especially preferably 3–5.

The tin(II) and zinc(II) ions are preferably used in the form of chlorides, sulfates or alkyl sulfonates.

Optionally, one or more conducting salts of the respective anions are additionally used. $NH_4Cl$ and/or $NH_4(CH_3SO_3)$ are preferred.

Preferred aliphatic carboxylic acids in the aqueous solution according to the invention are hydrocarboxylic acids and amino carboxylic acids; citric acids and alkali salts thereof are especially preferred.

The non-ionic surfactants of the present invention preferably have the formula (III)

$$R—O—(C_2H_4O)_nH \quad (III)$$

wherein R=alkyl, aryl, alkylaryl and n=1–100. Most preferably n is 6–15 and a total of carbon atoms in the aryl radical is 8–20.

In addition to these non-ionic surfactants, thioethers or amines of the formulae (IV) and (V) may be used as non-ionic surfactants.

$$R'—S—(C_2H_4O)_nH \quad (IV)$$

$$R''—N[(C_2H_4O)_nH]_2 \quad (V)$$

wherein R'=$C_{1-3}$ alkyl or —$(C_2H_4O)_nH$ and R"=$C_{5-20}$ alkyl and n=1–100, especially preferably n=6–15. Especially preferred are $H(C_2H_4O)_n—S—H(C_2H_4O)_nH$ with n=8 to 12 and $C_{12}H_{25}—N[(C_2H_4)O_nH]_2$ with n=15–25.

Aliphatic or aromatic sulfonates are preferably used as anionic surfactants. In a preferred embodiment, one or more compounds of the formulae (VI) to (IX) are selected:

(VI)

a') 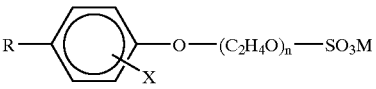

wherein R=$C_{3-12}$ alkyl; X=H, —$SO_3M$; M=Na, K, $NH_4$ $$b')\ R'—O—(C_2H_4O)_n—R''—SO_3M \quad (VII)$$

wherein R'=$C_{3-12}$ alkyl; R"=$C_{2-5}$ alkyl, M=Na, K, $NH_4$ (VIII)

c')

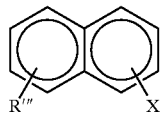

wherein R'''=H, $C_{1-5}$ alkyl, O—$(C_2H_4O)_n$—X; or

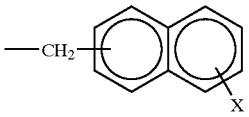

and X=$SO_3M$ with M=Na, K, $NH_4$ (IX)

d')

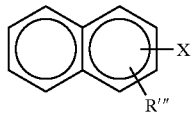

wherein R'''=H, $C_{1-5}$ alkyl, O—$(C_2H_4O)_n$—X; or

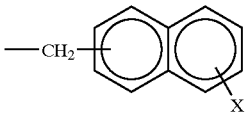

and X=$SO_3M$ with M=Na, K, $NH_4$ with n=8–14.

A particularly preferred selection from the above series are the anionic surfactants according to the following formulae (X) to (XIII)

(X)

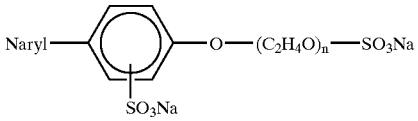

(XI)

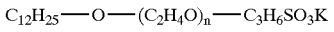

(XII)

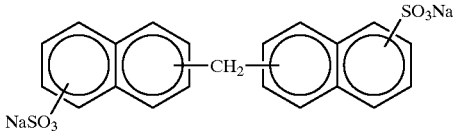

and (XIII)

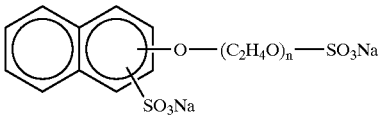

wherein n=8–14.

Optionally, the electroplating bath for depositing zinc-tin alloys may also contain aromatic and/or heterocyclic carboxylic acids or alkali salts thereof of the formula (XIV)

R—COOM (XIV)

wherein R=

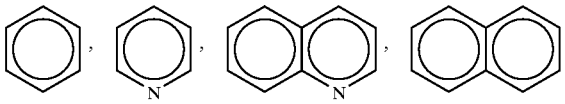

and M=H, Na, K, $NH_4$

Preferred embodiments of these carboxylic acids are nicotinic acid and/or Na benzoate.

The concentrations of the individual components are advantageously selected within the following ranges:

| | |
|---|---|
| zinc(II) ions | 5 g/l to 50 g/l |
| especially preferred | 20 g/l to 25 g/l |
| tin(II) ions | 0.5 g/l to 5 g/l |
| especially preferred | 1 g/l to 3 g/l |
| aliphatic carboxylic acids | 30 g/l to 200 g/l |
| especially preferred | 60 g/l to 140 g/l |
| non-ionic surfactants | |
| according to formula (III) | 0 g/l to 10 g/l |
| especially preferred | 0 g/l to 2 g/l |
| according to formula (IV) or (V) | 0 g/l to 10 g/l |
| especially preferred | 0 g/l to 2 g/l |
| anionic surfactants | 5 g/l to 30 g/l |
| especially preferred | 10 g/l to 15 g/l |
| aromatic aldehydes and/or aromatic ketones | 0 g/l to 0.5 g/l |
| especially preferred | 0 g/l to 0.2 g/l |
| aromatic and/or heterocyclic carboxylic acids or alkali salts thereof | 0.5 g/l to 10 g/l |
| especially preferred | 1 g/l to 3 g/l |
| conducting salts | 10 g/l to 150 g/l |
| especially preferred | 30 g/l to 70 g/l |

The present invention also comprises the use of the aqueous solutions described above for depositing tin-zinc coatings, especially tin-zinc coatings having a zinc content of 10 to 50 wt.-%.

The invention is illustrated by the following example.

| An aqueous solution was prepared from the following components: | |
|---|---|
| Citric acid | 100 g/l |
| $NH_4Cl$ | 50 g/l |
| $NH_4OH$, 25% | 90 g/l |
| $H_3BO_3$ | 30 g/l |
| $Sn^{2+}$ as $Sn(CH_3SO_3)_2$ | 3 g/l |
| $ZnCl_2$ | 33 g/l |
| 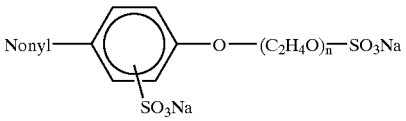 | 4 g/l |
| $C_{12}H_{25}$—O—$(C_2H_4O)_n$—$C_3H_6SO_3K$ | 5 g/l |
| 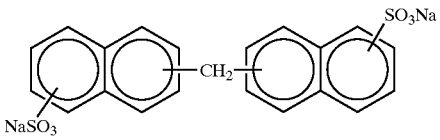 | 3 g/l |
| 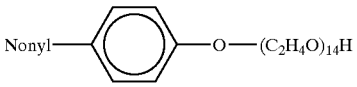 | 2 g/l |

-continued

| An aqueous solution was prepared from the following components: | |
|---|---|
| Na benzoate | 2 g/l |
| Nicotinic acid | 0.1 g/l |
| o-Cl benzaldehyde | 0.05 g/l |

With this solution, a tin-zinc alloy comprising 30% of zinc was deposited on a substrate surface having a thickness of 10 μm in a light-grey colour under the following conditions:

I=1 A/dm$^2$ t=20 min

T=40° C.

The above result shows that, with the aqueous solution according to the invention, tin-zinc alloys of a uniform thickness and composition and in a uniform light colour may be deposited without the use of cyanide ions and at a low energy consumption.

What is claimed is:

1. An aqueous solution for electroplating tin-zinc alloys comprising the following components:

a) Zn(II) ions;

b) Sn(II) ions;

c) aliphatic carboxylic acids and/or alkali salts thereof;

d) anionic surfactants; and e) non-ionic surfactants.

2. A solution according to claim 1 which additionally comprises aromatic aldehydes and/or aromatic ketones.

3. A solution according to claim 2 wherein the aromatic aldehydes and/or aromatic ketones have the formula (I)

$$AR—R—CO—R' \quad (I)$$

wherein AR=phenyl, naphthyl; R=$CH_2$, CH=CH; and R'=H, $C_{1-3}$ alkyl.

4. A solution according to claim 2, characterised in that the aromatic aldehydes have the formula (II)

(II)

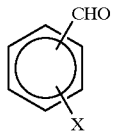

wherein X=H, $CH_3$, $OCH_3$, Cl, Br.

5. A solution according to claim 1, wherein the solution has a pH value of 2–8.

6. A solution according to claim 5, wherein the solution has a pH value of 3–5.

7. A solution according to claim 1, wherein the Sn(II) and Zn(II) ions are contained as chlorides, sulfates or alkyl sulfonates and, optionally, conducting salts of pertinent anions are also contained.

8. A solution according to claim 1, wherein the aliphatic carboxylic acids are hydroxy carboxylic acids and/or amino carboxylic acids or salts thereof.

9. A solution according to claim 8, wherein the carboxylic acids are citric acid or alkali salts thereof.

10. A solution according to claim 1, wherein the non-ionic surfactants have the formula (III)

$$R—O—(C_2H_4O)_nH \quad (III)$$

wherein R represents an alkyl, aryl, alkylaryl radical and n=1–100.

11. A solution according to claim 10, which additionally comprises non-ionic surfactants of the formula (IV)

$$R'—S—(C_2H_4O)_nH \quad (IV)$$

and/or of the formula (V)

$$R''N[(C_2H_4O)_nH]_2 \quad (V)$$

wherein R'=$C_{1-3}$ alkyl or —$(C_2H_4)_nH$; R"=$C_{5-20}$ alkyl and n=1–100.

12. A solution according to claim 1, wherein the anionic surfactants include one or more of the compounds of the formulae (VI) to (IX)

(VI)

a') 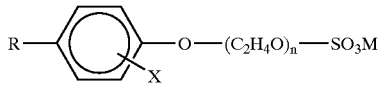

wherein R=$C_{3-12}$ alkyl; X=H, —$SO_3M$; M=Na, K, $NH_4$ b') $R'—O—(C_2H_4O)n—R''—SO_3M$ (VII)

wherein R'=$C_{3-12}$ alkyl; R"=$C_{2-5}$ alkyl, M=Na, K, $NH_4$ (VIII)

c') 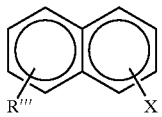

wherein R'''=H, $C_{1-5}$ alkyl, O—$(C_2H_4O)_n$—X; or

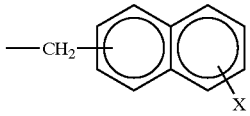

and X=$SO_3M$ with M=Na, K, $NH_4$ (IX)

d') 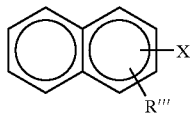

wherein R'''=H, $C_{1-5}$ alkyl, O—$(C_2H_4O)_n$—X; or

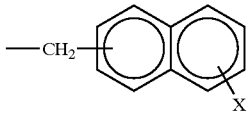

and X=$SO_3M$ with M=Na, K, $NH_4$ with n=0–100, preferably 6–15.

13. A solution to claim 1, which additionally comprises aromatic and/or heterocyclic carboxylic acids or alkali salts thereof.

14. A solution according to claim 13, wherein the carboxylic acids have the formula (XIV)

$$R—COOM \quad (XIV)$$

wherein R=
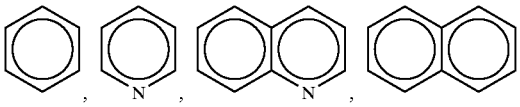
and M=H, Na, K, $NH_4$.
* * * * *